US011374347B2

(12) United States Patent
Yokotani

(10) Patent No.: US 11,374,347 B2
(45) Date of Patent: Jun. 28, 2022

(54) MOVABLE SUPPORT STRUCTURE

(71) Applicant: SUMITOMO WIRING SYSTEMS, LTD., Yokkaichi (JP)

(72) Inventor: Koichi Yokotani, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/890,093

(22) Filed: Jun. 2, 2020

(65) Prior Publication Data

US 2020/0403351 A1 Dec. 24, 2020

(30) Foreign Application Priority Data

Jun. 19, 2019 (JP) ..... JP2019-113553

(51) Int. Cl.
*H01R 13/514* (2006.01)
*H01R 13/453* (2006.01)
*H01R 13/422* (2006.01)

(52) U.S. Cl.
CPC ..... *H01R 13/514* (2013.01); *H01R 13/4223* (2013.01); *H01R 13/4538* (2013.01)

(58) Field of Classification Search
CPC ..... H01R 13/639; H01R 13/5205; H01R 13/4538; H01R 13/4223; H01R 13/514
USPC ..... 439/353, 354, 278, 282
See application file for complete search history.

(56) References Cited

U.S. PATENT DOCUMENTS 6,655,998 B1 * 12/2003 Kurimoto ..... H01R 13/4362 439/595
7,470,138 B1 * 12/2008 Chen ..... H01R 13/506 439/352
9,024,183 B2 * 5/2015 Sakakura ..... H01R 31/06 174/50.5
10,355,430 B2 * 7/2019 Yokotani ..... H01R 13/5213
10,797,420 B2 * 10/2020 Maesoba ..... H01R 12/58
2002/0086571 A1 * 7/2002 Fujita ..... H01R 12/721 439/188
2006/0170429 A1 * 8/2006 Nakamura ..... H01R 13/4534 324/538
2007/0059970 A1 * 3/2007 Ichio ..... H01R 13/6272 439/382
2012/0285097 A1 * 11/2012 Sakakura ..... H01R 13/5213 49/465
2015/0279583 A1 * 10/2015 Matsumura ..... H01H 9/02 200/293
2017/0125955 A1 * 5/2017 Higashikozono ... H01M 50/581

FOREIGN PATENT DOCUMENTS

JP 2017-091809 A 5/2017

* cited by examiner

*Primary Examiner* — Marcus E Harcum
(74) *Attorney, Agent, or Firm* — Oliff PLC

(57) ABSTRACT

A movable support structure, wherein the retaining/restricting portion is resiliently deformable in a direction to be retracted from a relative passage path for the receiving portion when the supported portion is inserted into the movable supporting portion from a catching posture, in which the retaining/restricting portion is caught by the receiving portion, with the supported portion supported by the movable supporting portion, and the deformation restricting portion restricts resilient deformation of the retaining/restricting portion in a direction to be retracted from the catching posture.

9 Claims, 11 Drawing Sheets

MOVABLE SUPPORT STRUCTURE

BACKGROUND

The present disclosure relates to a movable support structure.

Japanese Unexamined Patent Publication No. 2017-91809 discloses a sealing cover with a fitting portion and an interlock connector. The interlock connector is held in the fitting portion displaceably in a direction orthogonal to a fitting direction of the fitting portion.

SUMMARY

Here, it is desired to make a movable body such as an interlock connector difficult to come off with respect to a support.

Accordingly, the present disclosure provides a first component difficult to come off from a second component when the first component is supported relatively movably with respect to the second component.

The present disclosure is directed to a movable support structure with a first component including a movable supporting portion and a second component including a supported portion, wherein the movable supporting portion is configured to support the supported portion when the supported portion slides toward the movable supporting portion along a first direction and a second direction orthogonal to the first direction, one of the first and second components is formed with a receiving portion, the other of the first and second components is formed with a retaining/restricting portion and a deformation restricting portion, the retaining/restricting portion is resiliently deformable in a direction to be retracted from a relative passage path for the receiving portion when the supported portion is inserted into the movable supporting portion from a catching posture, in which the retaining/restricting portion is caught by the receiving portion, with the supported portion supported by the movable supporting portion, and the deformation restricting portion restricts resilient deformation of the retaining/restricting portion in a direction to be retracted from the catching posture.

According to the present disclosure, the first component is less likely to come off from the second component when the first component is supported relatively movably with respect to the second component.

DETAILED DESCRIPTION OF EMBODIMENTS

Figure 1:
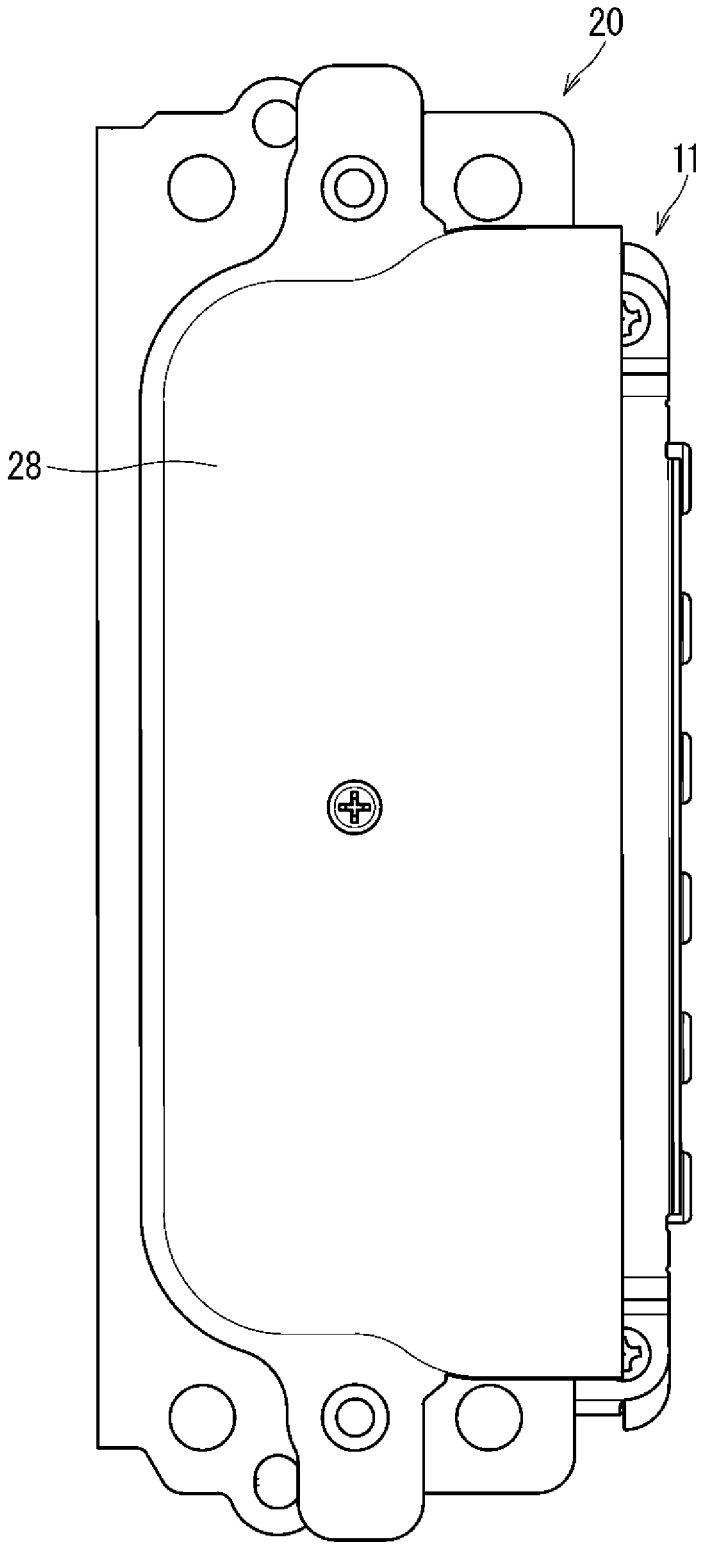
FIG. 1 is a plan view showing a cover according to an embodiment.

First, embodiments of the present disclosure are listed and described.

A movable support structure of the present disclosure is as follows.

The movable support structure is provided with a first component including a movable supporting portion and a second component including a supported portion, wherein the movable supporting portion is capable of supporting the supported portion slid toward the movable supporting portion along a first direction movably along the first direction and a second direction orthogonal to the first direction, one of the first and second components is formed with a receiving portion, the other of the first and second components is formed with a retaining/restricting portion and a deformation restricting portion, the retaining/restricting portion is resiliently deformable in a direction to be retracted from a relative passage path for the receiving portion when the supported portion is inserted into the movable supporting portion from a catching posture, in which the retaining/restricting portion is caught by the receiving portion, with the supported portion supported by the movable supporting portion, and the deformation restricting portion restricts resilient deformation of the retaining/restricting portion in the direction to be retracted from the catching posture. The deformation restricting portion restricts the resilient deformation of the retaining/restricting portion in the direction to be retracted from the catching posture. Thus, a state where the retaining/restricting portion is caught by the receiving portion is less likely to be released. Therefore, the first component is less likely to come off from the second component.

(2) The retaining/restricting portion may have a first contact surface and a second contact surface for contacting the receiving portion to resiliently deform the retaining/restricting portion in the direction to be retracted from the catching posture when the supported portion is slid toward the movable supporting portion, the first and second contact surfaces may be formed to have such a positional relationship that the first and second contact surfaces contact the receiving portion in this order when the supported portion is slid toward the movable supporting portion, and the second contact surface may be gentler than the first contact surface with respect to the first direction. In an initial stage of the contact of the retaining/restricting portion with the receiving portion, the first contact surface that is steep with respect to the first direction contacts the receiving portion and the retaining/restricting portion can be largely resiliently deformed. In a later stage where the retaining/restricting portion is resiliently deformed to a certain extent, the second contact surface that is gentle with respect to the first direction contacts the receiving portion and the retaining/restricting portion is resiliently deformed with a relatively small force. Thus, the retaining/restricting portion is smoothly caught by the receiving portion.

(3) The deformation restricting portion may contact the retaining/restricting portion with a part of the retaining/ restricting portion located in the relative passage path for the receiving portion. A state where the part of the retaining/restricting portion is caught by the receiving portion is easily maintained.

(4) An edge part of the receiving portion on a side catching the retaining/restricting portion with the supported portion supported by the movable supporting portion may be formed into a chamfered shape. The deformation restricting portion restricts a movement of the retaining/restricting portion, whereby the retaining/restricting portion interferes with the receiving portion. Thus, even if the receiving portion is deformed, a projecting amount of the deformed part can be made smaller by the part of the receiving portion having the chamfered shape. Therefore, a movable region of the supported portion is easily ensured.

(5) A tip part of a catching part of the receiving portion catching the retaining/restricting portion with the supported portion supported by the movable supporting portion may include a first projecting part projecting further than a base end side of the catching part. Since the receiving portion is less likely to be deformed, the first component is less likely to come off from the second component.

(6) A tip part of a caught part of the retaining/restricting portion caught by the receiving portion with the supported portion supported by the movable supporting portion may include a second projecting part projecting further than a base end side of the caught part. Since the first and second projecting parts are engaged with each other with the receiving portion and the retaining/restricting portion caught by each other, the first component is less likely to come off from the second component.

(7) The first projecting part may have a first surface gradually projecting toward the tip part of the catching part of the receiving portion catching the retaining/restricting portion, and the second projecting part may have a second surface gradually projecting toward the tip part of the caught part of the retaining/restricting portion caught by the receiving portion. If the retaining/restricting portion is pressed against the receiving portion, the receiving portion and the retaining/restricting portion are more reliably caught by each other by the action of the first and second surfaces. Thus, the first component is less likely to come off from the second component.

(8) One of the first and second components may be a cover body for closing an opening provided in a device housing, and the other of the first and second components may be a connector to be connected to a mating connector provided in the device housing. The connector is less likely to come off from the cover body.

A specific example of the movable support structure of the present disclosure is described below with reference to the drawings. Note that the present disclosure is not limited to these illustrations

Embodiment

Figure 2:
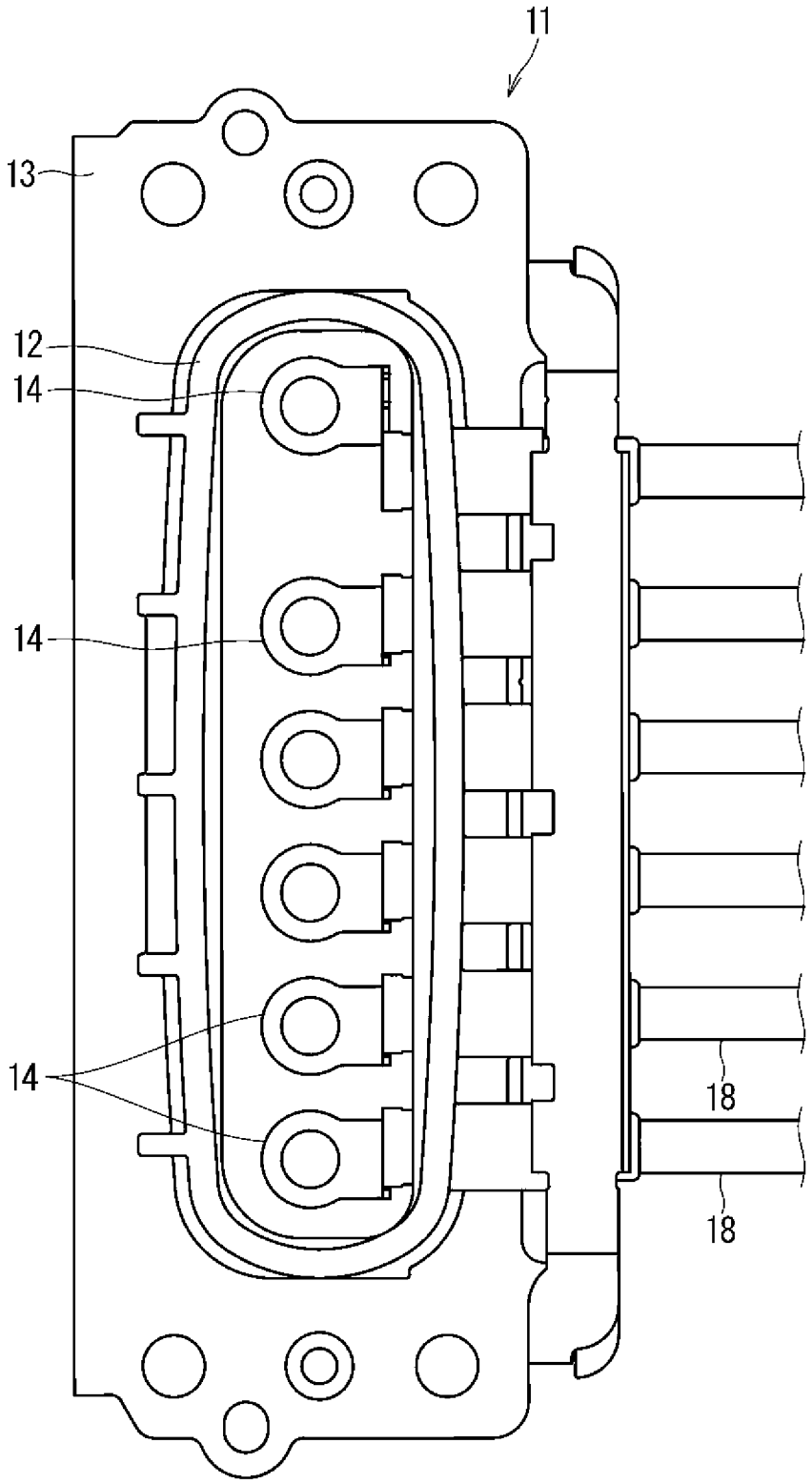
FIG. 2 is a plan view showing an opening portion of a device housing, on which the cover is mounted.
Figure 3:
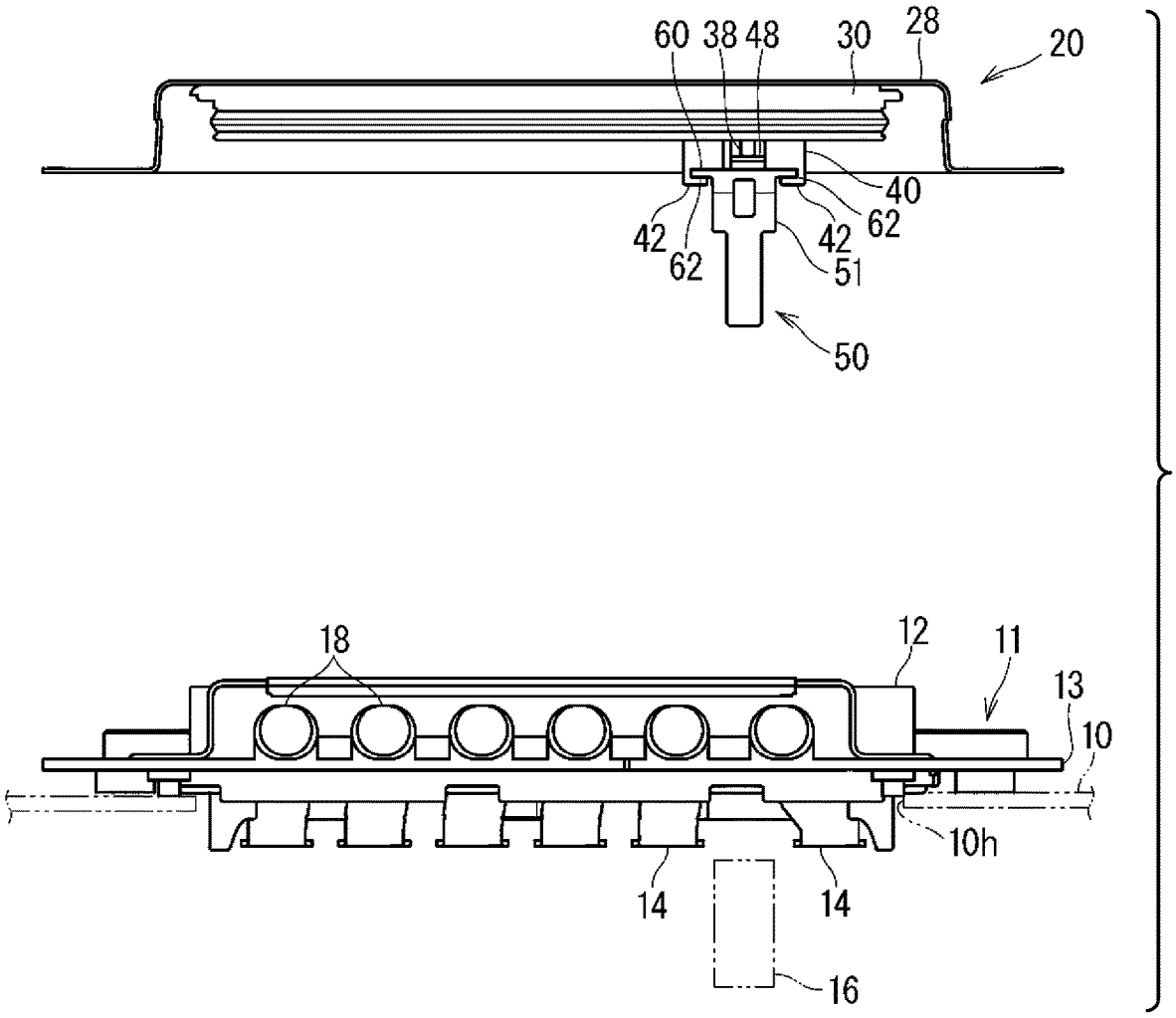
FIG. 3 is a view showing a state while the cover is being mounted on the opening portion.

Hereinafter, a movable support structure according to an embodiment is described. In this embodiment, an example in which the movable support structure is a cover to be mounted on an opening portion of a device housing is described. FIG. 1 is a plan view showing a cover 20. FIG. 2 is a plan view showing an opening portion 11 of a device housing 10, on which the cover 20 is mounted. FIG. 3 is a view showing a state while the cover 20 is being mounted on the opening portion 11.

The device housing 10 is a member made of metal or the like and is, for example, a case of an electrical device (see FIG. 3). This device housing 10 is formed with an opening **10*h*. The opening portion 11 is mounted on this opening 10*h*. The opening portion 11 includes a tubular portion 12 and a bracket portion 13. The tubular portion 12 is made of resin or the like. Here, the tubular portion 12 is formed into an elongated tube. The bracket portion 13 is formed of a metal plate or the like. The bracket portion 13 protrudes toward an outer peripheral side of the tubular portion 12 in an axially intermediate part of an outer peripheral part of the tubular portion 12. This bracket portion 13 is fixed to the device housing 10 by screws or the like. With the bracket portion 13 fixed to the device housing 10, the tubular portion 12 is located in the opening 10*h* of the device housing 10**.

A plurality of terminals 14 are held in the tubular portion 12. A tip part of the terminal 14 is in the tubular portion 12 or on an extension of the inside of the tubular portion 12 in the device housing 10. A base end part of the terminal 14 is connected to an end part of a wire 18 by crimping or the like. The wire 18 extends outward from the tubular portion 12.

With the opening portion 11 mounted on the device housing 10, the tip parts of the terminals 14 are overlapped on internal terminals provided in the device housing 10 and held connected to the internal terminals by screwing or the like. Thus, the wires 18 are electrically connected to the internal terminals via the terminals 14. That is, the opening portion 11 functions as one type of a connector.

A space in the tubular portion 12 is open outwardly of the device housing 10. The cover 20 is a cover for closing an outer opening of the tubular portion 12.

The cover 20 includes a cover body 30 and a connector 50.

The cover body 30 is a member made of resin or the like and shaped to be fittable into the tubular portion 12. Here, the cover body 30 is in the form of a plate shaped in conformity with the inner peripheral surface shape of the tubular portion 12 in a plan view. The opening of the tubular portion 12 is closed by fitting the cover body 30 into the tubular portion 12.

Here, a shield cover 28 formed of a metal plate is mounted outside the cover body 30. Here, the shield cover 28 is fixed to the cover body 30 by screwing or the like. With the cover body 30 fit in the tubular portion 12, the shield cover 28 electromagnetically shields by covering the outer side and outer peripheral side of the opening portion 11. In this state, the shield cover 28 is grounded to the bracket portion 13 by screwing or the like. The shield cover 28 is not essential and may be omitted.

The connector 50 is a member held relatively movably within a predetermined range with respect to the cover body 30. Here, the connector 50 is movably held on a part of the cover body 30 facing the inside of the device housing 10. A mating connector 16 is provided in the device housing 10 (see FIG. 3). The mating connector 16 is a connector connectable to the connector 50. The mating connector 16 is supported at a position connectable to the connector 50 held by the cover body 30 with the cover body 30 fit in the tubular portion 12.

It is assumed that the mating connector 16 is a connector including two terminals and the connector 50 also include two terminals. It is also assumed that the two terminals of the connector 50 are made conductive by a shorting member such as a wire. If the cover 20 is mounted on the opening portion 11, the connector 50 is connected to the mating connector 16. Then, the two terminals of the mating connector 16 are connected to the corresponding two terminals in the connector 50 and become conductive therewith.

A manufacturing error, an assembly error and the like easily occur at a position where the mating connector 16 is arranged with respect to the opening portion 11. Further, a manufacturing error, an assembly error and the like also easily occur at a position where the connector 50 is held with respect to the cover body 30. To absorb such errors, the connector 50 is supported movably within the predetermined range with respect to the cover body 30.

In this embodiment, the cover body 30 is an example of a first component including a movable supporting portion. The connector 50 is an example of a second component including a supported portion. A movable supporting portion 40 is provided in a widthwise intermediate part of the cover body 30. Here, the cover body 30 is formed into an elongated shape in a plan view, and it is assumed that a longitudinal direction thereof is a width direction and a transverse direction thereof is a depth direction. The movable supporting portion 40 movably supports the connector 50 at a position between any adjacent ones of the plurality of terminals 14. The movable supporting portion 40 may be supported at such a position that the connector 50 can be guided into the device housing 10 while avoiding the plurality of terminals 14 and the position thereof is not particularly limited. A supported portion 60 is provided on a base end part of the connector 50. The connector 50 is movably supported by the movable supporting portion 40 via the supported portion 60.

The movable supporting portion 40 and the supported portion 60 are more specifically described.

Figure 4:
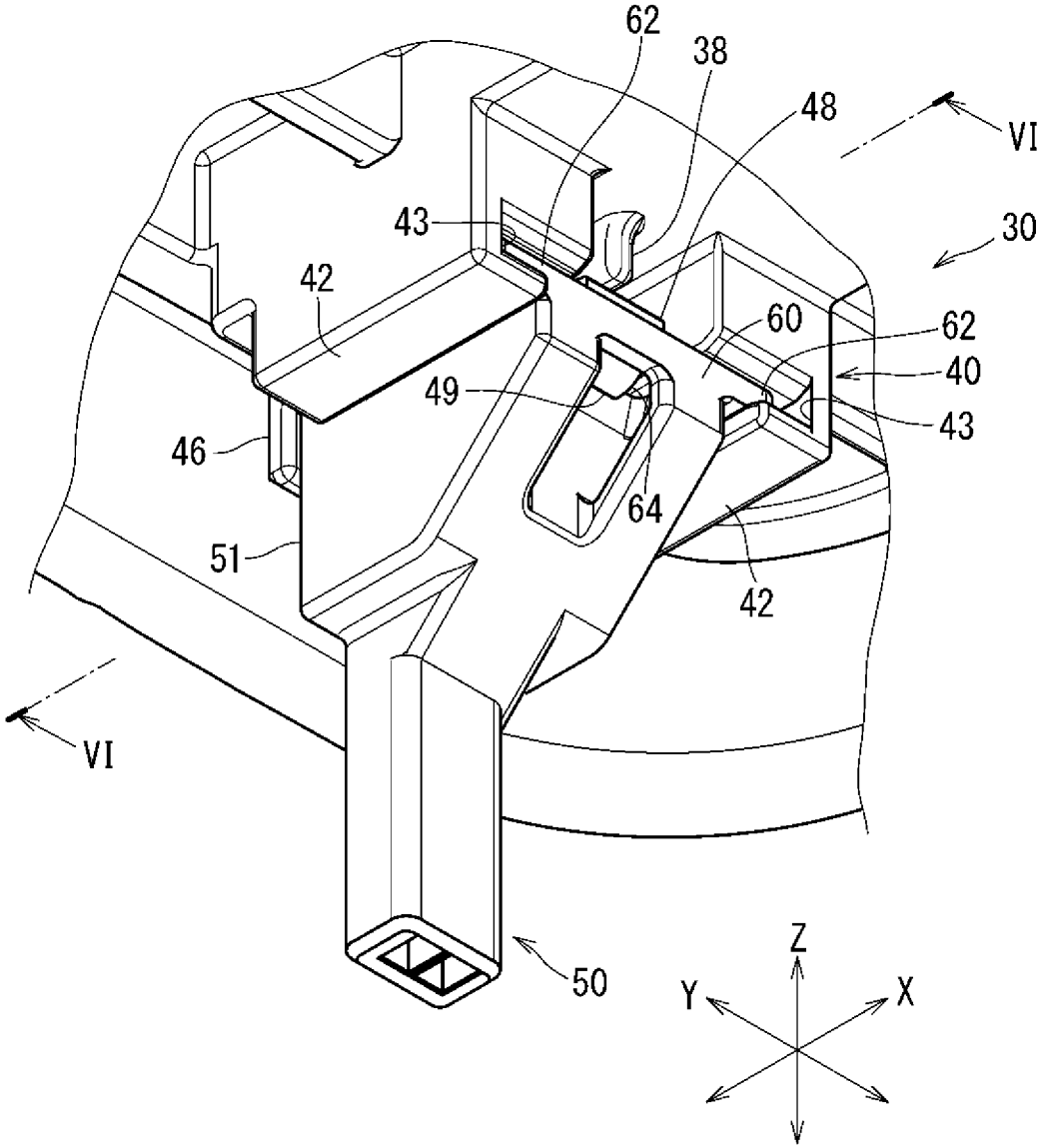
FIG. 4 is a perspective view showing a movable supporting portion and a supported portion.
Figure 5:
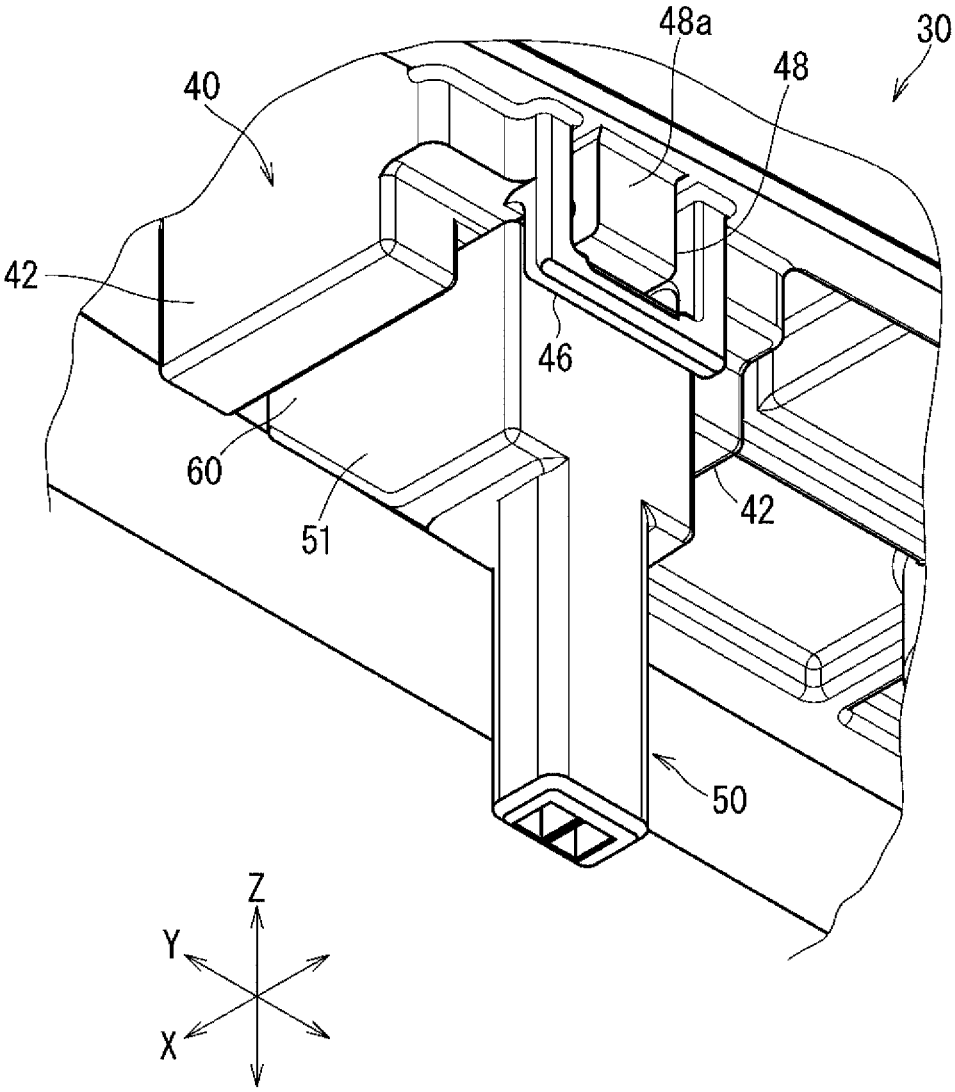
FIG. 5 is a perspective view showing the movable supporting portion and the supported portion.
Figure 6:
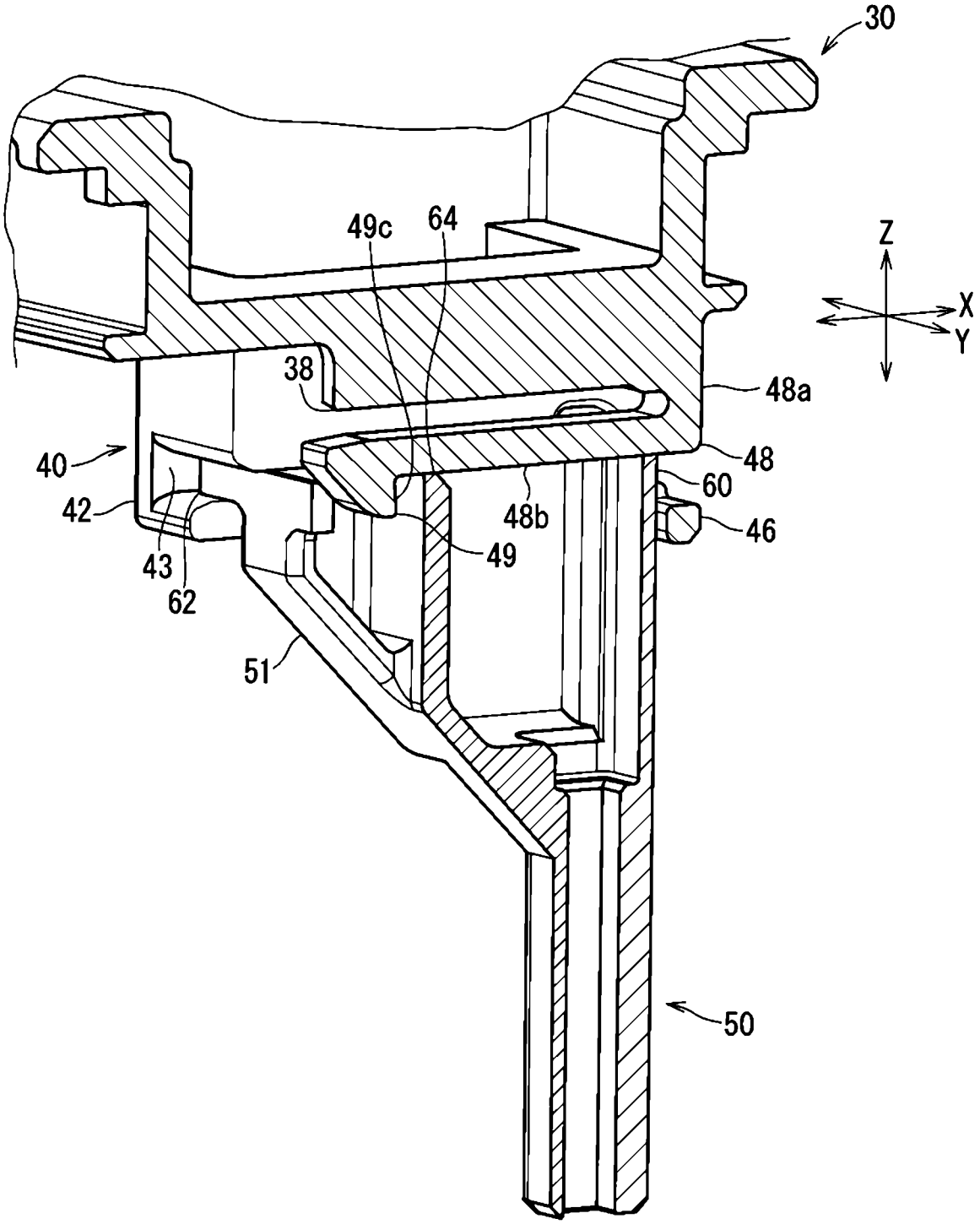
FIG. 6 is a perspective view showing a cross-section along VI-VI of FIG. 4.
Figure 7:
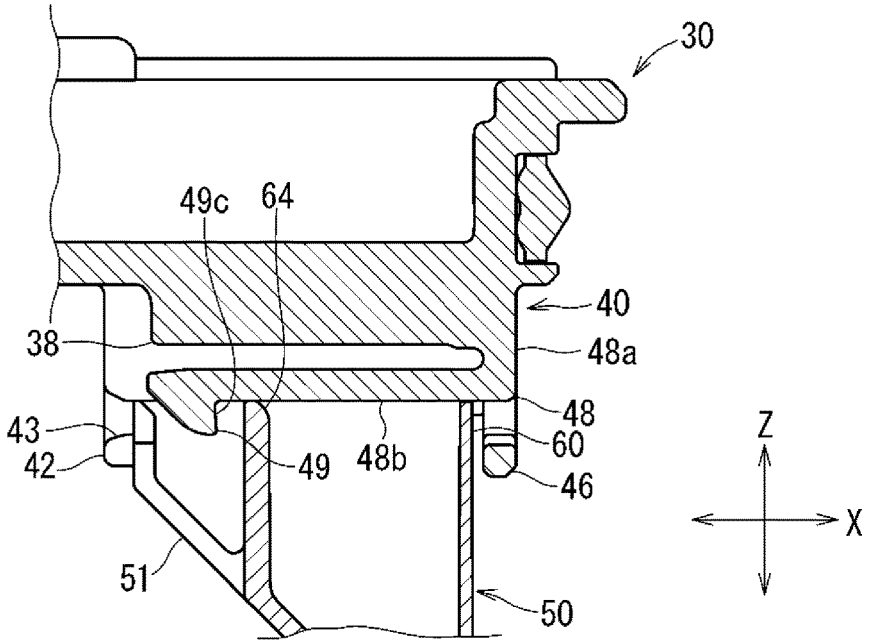
FIG. 7 is a section along VI-VI of FIG. 4.

FIGS. 4 and 5 are perspective views showing the movable supporting portion 40 and the supported portion 60. FIG. 6 is a perspective view showing a cross-section along VI-VI of FIG. 4. FIG. 7 is a section along VI-VI of FIG. 4.

The movable supporting portion 40 supports the supported portion 60 slid toward the movable supporting portion 40 along a first direction X. The movable supporting portion 40 supports the supported portion 60 movably in the first direction X and a second direction Y Here, the first direction X is a direction in which the supported portion 60 moves toward the movable supporting portion 40 when the supported portion 60 is supported with respect to the movable supporting portion 40. The second direction Y is a direction orthogonal to the first direction X. Here, if an extending direction of the connector 50 with respect to the cover body 30 is a third direction Z, the second direction Y is orthogonal to both the first and third directions X, Z. Note that the third direction Z may be comprehended as a connecting direction of the connector 50 to the connector 16.

More specifically, the movable supporting portion 40 includes a pair of sliding support portions 42 and a back-side stop portion 46.

The pair of sliding support portions 42 are formed to project while being spaced apart on a part of the cover body 30 facing the device housing 10. The sliding support portions 42 are in the form of elongated protrusions. Here, the sliding support portions 42 are formed into elongated protrusions extending along the depth direction of the cover body 30. The pair of sliding support portions 42 are formed side by side while being spaced apart in the width direction of the cover body 30. Sliding support grooves 43 extending along an extending direction of the sliding support portions 42 are formed in inward facing parts of the pair of sliding support portions 42. A pair of the sliding support grooves 43 are open on sides facing each other and one end side in the extending direction.

The back-side stop portion 46 is provided on a back side of the movable supporting portion 40 in a sliding direction of the supported portion 60. Here, the back-side stop portion 46 is provided to project from a position between the pair of sliding support portions 42 to a position on one side in the depth direction of the cover body 30 on a part of the cover body 30 facing the device housing 10. Here, the back-side stop portion 46 is shaped to include a pair of bar-like parts projecting from the cover body 30 and a coupling portion coupling the pair of bar-like parts. If the supported portion 60 is slid to be inserted between the pair of sliding support portions 42, the supported portion 60 contacts the back-side stop portion 46 to restrict any further backward movement.

The supported portion 60 is a part forming the base end part of the connector 50. Here, a base end part 51 of the connector 50 is formed into a shape projecting in three directions with respect to a tip side part of the connector 50. The base end part 51 of the connector 50 projects from both sides of the connector 50 via steps and projects in the other one direction via an inclined surface.

The supported portion 60 includes a pair of projecting pieces 62 projecting from the both sides of the base end part 51 of the connector 50. The pair of projecting pieces 62 are respectively in the form of plates fittable into the sliding support grooves 43. An interval between outward facing surfaces of the pair of projecting pieces 62 is larger than that between the inner surfaces of the pair of sliding support portions 42, but smaller than that between groove bottom surfaces of the pair of sliding support grooves 43. Further, a dimension between both side surfaces of the base end part 51 of the connector 50 is smaller than the interval between the inner surfaces of the pair of sliding support portions 42. Thus, the supported portion 60 of the base end part 51 of the connector 50 can move within the predetermined range along the second direction Y, which is a direction connecting the pair of sliding support portions 42.

Further, a movement of the supported portion 60 in the sliding direction along the first direction X is restricted by the back-side stop portion 46. In a direction opposite to the sliding direction, i.e. a direction in which the supported portion 60 escapes from the movable supporting portion 40, a movement of the supported portion 60 is restricted by catching engagement of a receiving portion 64 and a retaining/restricting portion 48 to be described later.

Note that a configuration for supporting the supported portion movably within the predetermined range by the movable supporting portion is not limited to the above example. For example, the movable supporting portion may be a protrusion having a T-shaped cross-section, and the supported portion may be a groove having a T-shaped cross-section, the protrusion having a T-shaped cross-section being slidably fit into the groove with play. Further, the back-side stop portion may be a projection or the like formed at an intermediate position of the sliding support groove 43.

One of the cover body 30 and the connector 50 is formed with the receiving portion 64, and the other is formed with the retaining/restricting portion 48. Here, an example in which the connector 50 is formed with the receiving portion 64 and the cover body 30 is formed with the retaining/restricting portion 48 is described.

The base end part 51 of the connector 50 is open when viewed from the side of the movable supporting portion 40. The receiving portion 64 is formed in the base end part 51. The receiving portion 64 is in the form of a plate orthogonal to an extending direction of the pair of projecting pieces 62 in an opening of the base end part 51. An end edge part (end edge) of the receiving portion 64 extends to be orthogonal to the pair of projecting pieces 62 between the pair of projecting pieces 62. The retaining/restricting portion 48 can be caught by the end edge part of the receiving portion 64. Note that a tip edge part of the receiving portion 64 on a side in the direction X where the supported portion 60 is slid and inserted is formed into a chamfered slope shape.

The retaining/restricting portion 48 is provided to extend from a back side to a front side of the movable supporting portion 40 in the sliding direction of the supported portion 60. More specifically, the retaining/restricting portion 48 includes a base portion 48*a*, an arm portion 48*b* and a protrusion 49. The base portion 48*a* projects from a part of the cover body 30 facing the device housing 10. The arm portion 48*b* extends along the extending direction of the pair of sliding support portions 42 from a tip part of the base portion 48*a* toward the position between the pair of sliding support portions 42. The protrusion 49 projects toward the connector 50 from a tip part of the arm portion 48*b*. That is, the retaining/restricting portion 48 is a long part formed into an L shape.

The arm portion 48*b* of the retaining/restricting portion 48 can be resiliently deformed in the direction Z, which is the longitudinal direction of the connector 50, with the side of the base portion 48*a* as a center. In this embodiment, the base portion 48*a* is provided between the pair of bar-like parts in the back-side stop portion 46. Thus, the arm portion 48*b* becomes relatively long and a sufficient resilient deformation region can be provided.

In a natural state where the retaining/restricting portion 48 is not resiliently deformed, the protrusion 49 is present at a position overlapping the receiving portion 64 when the protrusion 49 is projected along the sliding direction of the supported portion 60. Thus, with the supported portion 60 slid and mounted in the movable supporting portion 40, the protrusion 49 of the retaining/restricting portion 48 is in contact with the receiving portion 64 and retains the supported portion 60. This posture of the retaining/restricting portion 48 is a catching posture in which the retaining/restricting portion 48 is caught by the receiving portion 64. Note that, with the retaining/restricting portion 48 caught by the receiving portion 64, a distance between an inward facing surface of the back-side stop portion 46 and that of the protrusion 49 is longer than a distance between a part of the connector 50 facing the back-side stop portion 46 and a part of the receiving portion 64 facing the protrusion 49. Thus, the base end part 51 of the connector 50 can move in a range restricted by the back-side stop portion 46 and the protrusion 49 also in the first direction X.

Figure 8:
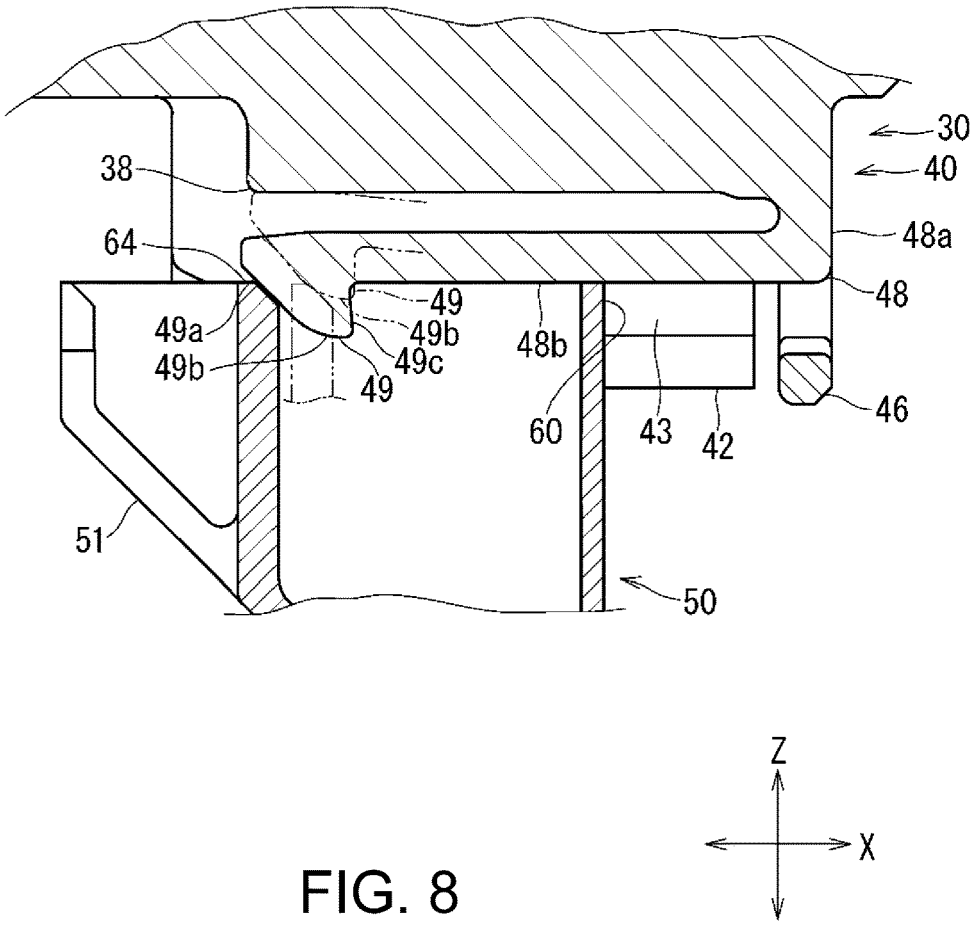
FIG. 8 is a section showing a state while a retaining/restricting portion is being caught by a receiving portion.
Figure 9:
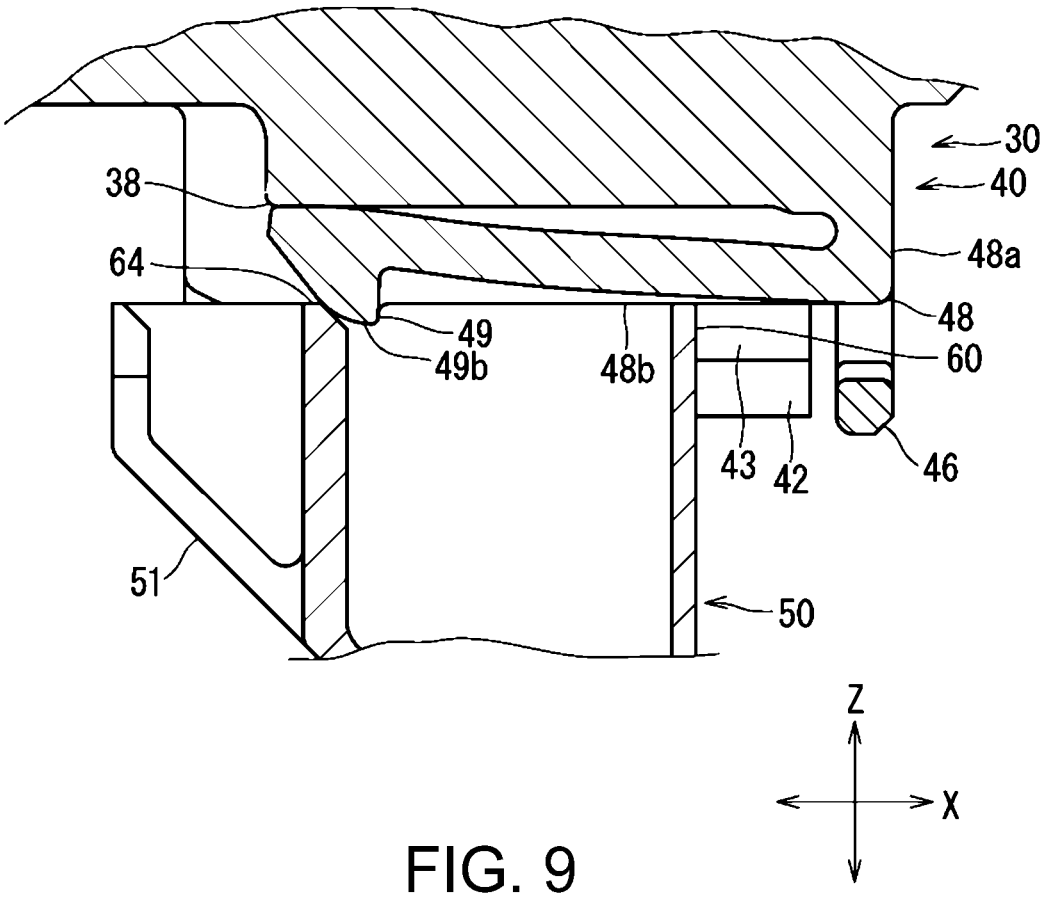
FIG. 9 is a section showing a state while the retaining/restricting portion is being caught by the receiving portion.

Further, the retaining/restricting portion 48 is resiliently deformable from the above catching posture in a direction to be retracted from a relative passage path for the receiving portion 64 when the supported portion 60 is inserted into the movable supporting portion 40, i.e. from the connector 50 toward the cover body 30 (see FIGS. 8 and 9). As the retaining/restricting portion 48 moves from the catching posture in the retracting direction, a degree of interference of the protrusion 49 and the receiving portion 64 becomes smaller.

When the supported portion 60 of the connector 50 is mounted into the movable supporting portion 40 of the cover body 30, the receiving portion 64 contacts the protrusion 49. In this way, the retaining/restricting portion 48 is resiliently deformed in the retracting direction from the catching posture. If the receiving portion 64 moves beyond the protrusion 49, the retaining/restricting portion 48 returns to the catching posture. In this way, the protrusion 49 is caught by the receiving portion 64 and the escape of the supported portion 60 from the movable supporting portion 40 is suppressed.

To enable the retaining/restricting portion 48 to be smoothly retracted and reliably maintain a state where the protrusion 49 is reliably caught by the receiving portion 64 is reliably maintained during the above mounting, the protrusion 49 is configured as follows.

The protrusion 49 projects toward the connector 50 from the tip part of the arm portion 48*b*. A part of the protrusion 49 on a tip side of the arm portion 48*b* (i.e. a part on a side opposite to a side toward which the supported portion is slid) is formed with contact surfaces 49*a*, 49*b* for contacting and resiliently deforming the receiving portion 64 in the direction to retract the retaining/restricting portion 48 from the catching posture. More specifically, the contact surfaces 49*a*, 49*b* are formed into slopes gradually extending in the retracting direction toward the tip side of the arm portion 48*b* (i.e. toward the side opposite to the side toward which the supported portion is slid).

If it is assumed that the contact surface 49*a* is a first contact surface 49*a* and the contact surface 49*b* is a second contact surface 49*b*, the first contact surface 49*a* is located closer to the tip side of the arm portion 48*b* than the second contact surface 49*b*. Thus, when the supported portion 60 is slid toward the movable supporting portion 40, the receiving portion 64 contacts the second contact surface 49*b* after contacting the first contact surface 49*a*. The second contact surface 49*b* is gentler than the first contact surface 49*a* with respect to the above first direction X. That is, the second contact surface 49*b* is sloped more along the first direction X than the first contact surface 49*a*.

Thus, when the supported portion 60 is mounted into the movable supporting portion 40, the receiving portion 64 first contacts the first contact surface 49*a*. Since the first contact surface 49*a* is a relatively steep slope, the arm portion 48*b* relatively suddenly moves in the retracting direction as the supported portion 60 is slid.

If the supported portion 60 is moved backward to a certain extent, the amount of resilient deformation of the arm portion 48*b* increases. Thus, a force necessary to resiliently deform the arm portion 48*b* increases. However, if the supported portion 60 is moved backward to a certain extent, the receiving portion 64 contacts the relatively gentle second contact surface 49*b*. Since the second contact surface 49*b* is a relatively gentle slope, the amount of resilient deformation of the arm portion 48*b* according to a sliding movement of the supported portion 60 relatively decreases. Thus, a pushing force increasing factor due to an increase in the resilient deformation of the arm portion 48*b* when the supported portion 60 is moved backward to a certain extent is alleviated to a certain extent by the action of the gently inclined second contact surface 49*b*. In this way, the supported portion 60 can be smoothly mounted into the movable supporting portion 40. Note that it is not essential to change the inclination of the protrusion 49 at an intermediate position such as a change in inclination given by the contact surfaces 49*a*, 49*b*.

The component provided with the retaining/restricting portion 48, out of the cover body 30 and the connector 50, is provided with a deformation restricting portion 38. Here, the cover body 30 is provided with the deformation restricting portion 38. The deformation restricting portion 38 is a part for restricting resilient deformation of the retaining/restricting portion 48 in the retracting direction from the catching posture.

More specifically, the deformation restricting portion 38 is formed on a part of the cover body 30 facing the device housing 10 and at a position overlapping the arm portion 48*b* in a back view. The deformation restricting portion 38 is in the form of an elongated projection projecting from the cover body 30. A clearance is provided between the deformation restricting portion 38 and the arm portion 48*b*. Thus, the retaining/restricting portion 48 can be retracted from the catching posture by that clearance. When being retracted to a certain extent, the retaining/restricting portion 48 contacts the deformation restricting portion 38 to restrict any further retracting deformation.

The deformation restricting portion 38 preferably contacts the retaining/restricting portion 48 to restrict the retracting deformation of the retaining/restricting portion 48 with a part of the retaining/restricting portion 48 located in the relative passage path for the receiving portion 64. Specifically, a tip part of the protrusion 49 is preferably located in the relative passage path for the receiving portion 64 with the retaining/restricting portion 48 resiliently deformed until contacting the deformation restricting portion 38 (see FIG. 9). Further, in other words, the tip part of the protrusion 49 and the receiving portion 64 are preferably in an overlapping positional relationship with the retaining/restricting portion 48 held in contact with the deformation restricting portion 38 when the protrusion 49 is projected in the sliding direction of the supported portion 60.

In this case, although the protrusion 49 moves to be retracted to a certain extent when the supported portion 60 is slid and mounted into the movable supporting portion 40, the tip part of the protrusion 49 cannot be completely retracted from the relative passage path for the receiving portion 64. Thus, the protrusion 49 rides over the receiving portion 64 by at least one of resilient deformation of the receiving portion 64, plastic deformation of the receiving portion 64 and plastic deformation of the protrusion 49.

In this case, a large force is thought to be necessary for the protrusion 40 to ride over the receiving portion 64. As described above, the second contact surface 49*b* formed into a gentle surface can contribute to a reduction in force for riding over the receiving portion 64 when the protrusion 49 rides over the receiving portion 64.

Further, a surface of the protrusion 49 on a base end side of the arm portion 48*b* (surface on the side toward which the supported portion 60 is slid) is formed into a contact surface 49*c* orthogonal to the sliding direction. With the protrusion 49 caught by the receiving portion 64, the contact surface 49*c* and the surface of the receiving portion 64 can contact each other as surfaces orthogonal to the sliding direction. Thus, the protrusion 49 is easily disengaged from the receiving portion 64.

According to the movable support structure configured as just described, the connector 50 is held movably to a certain extent with respect to the cover body 30. Thus, if a force in an unplanned direction is applied to the connector 50 and the connector 50 is inclined, the retaining/restricting portion 48 may be deformed to be retracted. In this case, the deformation restricting portion 38 restricts resilient deformation of the retaining/restricting portion 48 in the retracting direction from the catching posture. Thus, it is difficult to release the state of the retaining/restricting portion 48 caught by the receiving portion 64. Therefore, the connector 50 is less likely to come off from the cover body 30.

Further, in an initial stage of the contact of the retaining/restricting portion 48 with the receiving portion 64, the first contact surface 49*a* that is steep with respect to the first direction X contacts the receiving portion 64. Thus, the retaining/restricting portion 48 can be largely resiliently deformed according to a movement of the connector 50. In a later stage where the retaining/restricting portion 48 is resiliently deformed to a certain extent, the second contact surface 49*b* that is gentle with respect to the first direction X contacts the receiving portion 64. Thus, the retaining/restricting portion 48 can be resiliently deformed with a relatively small force. As a result, the retaining/restricting portion 48 is smoothly caught by the receiving portion 64.

Further, the deformation restricting portion 38 contacts the retaining/restricting portion 48 with the tip part of the protrusion 49, which is a part of the retaining/restricting portion 48, located in the relative passage path for the receiving portion 64. Thus, a state where the part of the retaining/restricting portion 48 is caught by the receiving portion 64 is easily maintained. This invariably occurs regardless of which of resilient deformation of the receiving portion 64, plastic deformation of the receiving portion 64 and plastic deformation of the protrusion 49 occurs when the protrusion 49 rides over the receiving portion 64. For example, it is assumed that either plastic deformation of the receiving portion 64 or plastic deformation of the protrusion 49 occurs when the protrusion 49 rides over the receiving portion 64. In this case, the protrusion 49 and the receiving portion 64 can contact each other substantially without play with the retaining/restricting portion 48 held in contact with the deformation restricting portion 38. Thus, the protrusion 49 is less likely to ride over the receiving portion 64 in an opposite direction. Further, if the receiving portion 64 is resiliently deformed when the protrusion 49 rides over the receiving portion 64, the receiving portion 64 is less likely to be resiliently deformed since the protrusion 49 is in contact with the receiving portion 64 via the contact surface 49*c*. Thus, also in this case, the protrusion 49 is less likely to ride over the receiving portion 64 in the opposite direction.

Further, since one of the first and second components is the cover body 30 and the other is the connector 50, the connector 50 is less likely to come off in the configuration for movably supporting the connector 50 by the cover body 30.

Modifications

Various modifications are described, assuming the above embodiment.

Figure 10:
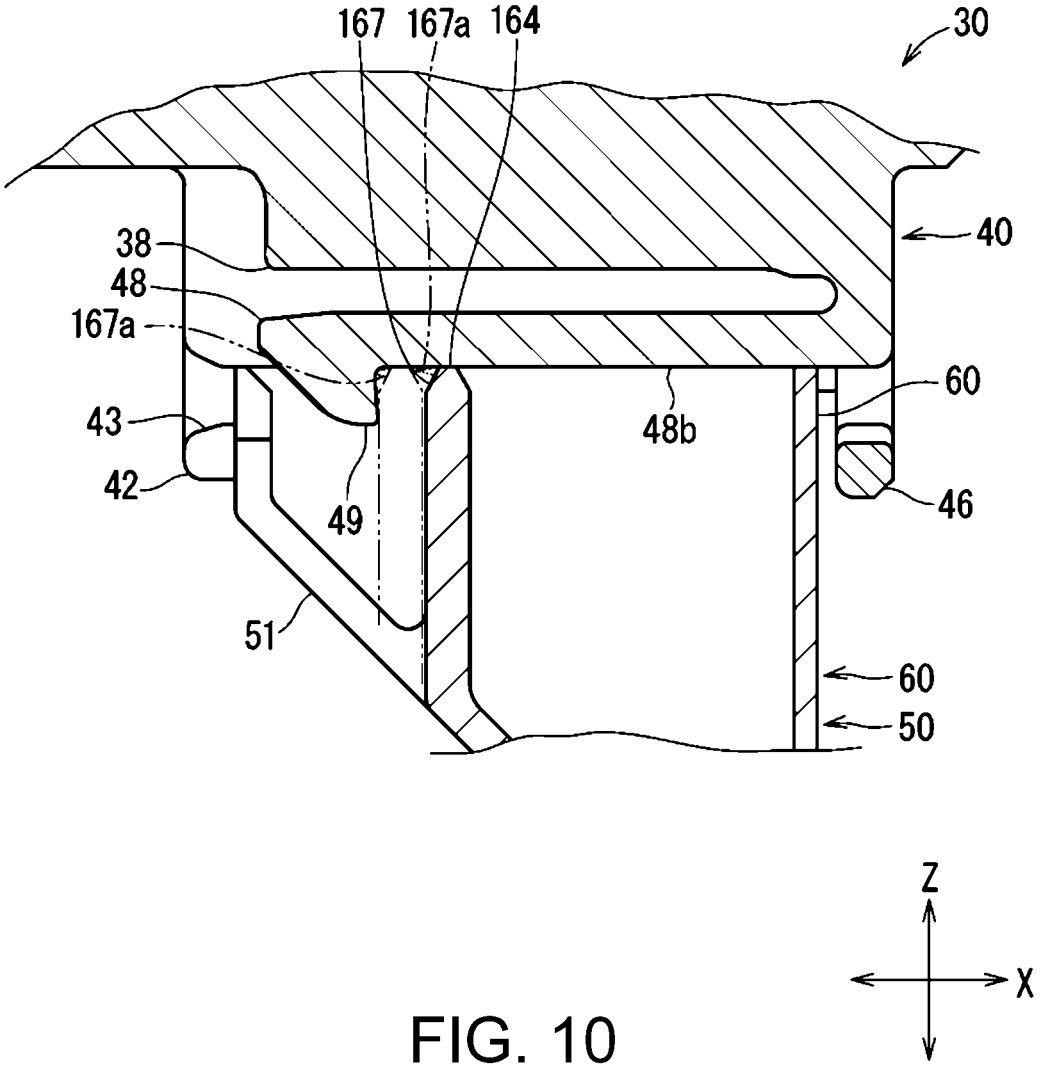
FIG. 10 is a section showing a retaining/restricting portion and a receiving portion according to a first modification.

As in a first modification shown in FIG. 10, an edge part on a side of a receiving portion 164 (corresponding to the receiving portion 64) catching the retaining/restricting portion 48 with the supported portion 60 supported by the movable supporting portion 40 may be formed into a chamfered part 167 having a chamfered shape. Here, the chamfered shape may be a shape obtained by cutting a corner between orthogonal surfaces by a plane or a rounded shape. Further, the chamfered part 167 needs not be formed by working the corner between the orthogonal surfaces and may be a part worked into this shape from an initial stage of manufacturing (e.g. shape of a mold itself).

According to the above embodiment, the retaining/restricting portion 48 interferes with the receiving portion 64 by restricting a movement of the retaining/restricting portion 48 by the deformation restricting portion 38. Thus, an edge of the receiving portion 64 may be plastically deformed and a plastic deformation mark may be possibly formed in a moving direction of the protrusion 49 from the edge of the receiving portion 64. Since such a plastic deformation mark can be present between the receiving portion 64 and the protrusion 49, a movable region of the supported portion 60 may be narrowed. If the chamfered part 167 is present on the receiving portion 164 as in this modification, even if a plastic deformation mark 167*a* is formed, most of the plastic deformation mark 167*a* is expected to be disposed in a space formed by the chamfered part 167*a*. Thus, a projecting amount of the plastic deformation mark 167*a* can be reduced and the movable region of the supported portion 60 is easily ensured. In other words, as small a movable region as possible can be ensured without minding plastic deformation. Since as small a movable region as possible can be ensured, the movable range of the connector 50 is reduced and the connector 50 can be made difficult to come off.

Figure 11:
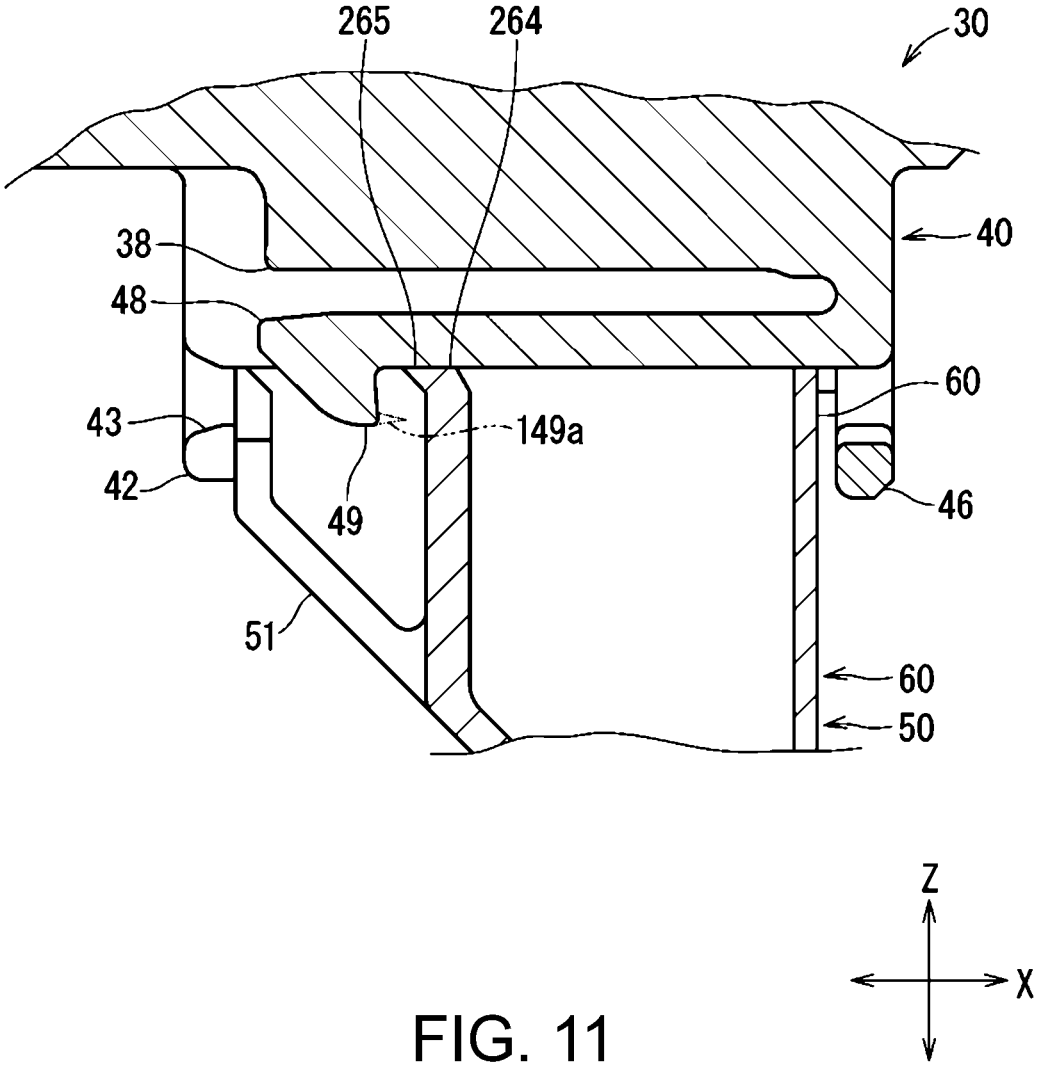
FIG. 11 is a section showing a retaining/restricting portion and a receiving portion according to a second modification.

As in a second modification shown in FIG. 11, a tip part (tip) of a catching part of a receiving portion 264 (corresponding to the receiving portion 64) catching the retaining/restricting portion 48 with the supported portion 60 supported by the movable supporting portion 40 may include a first projecting part 265 (first projection). The first projecting part 265 is a part projecting further in the first direction X than the other part (part on the base end side) of a catching surface of the receiving portion 264 catching the retaining/restricting portion 48. The first projecting part 265 projects along an extending direction of an edge of the receiving portion 264.

In this case, the edge of the receiving portion 264 is thickened by the first projecting part 265. Thus, the receiving portion 264 is less likely to be deformed and the catching engagement of the protrusion 49 and the receiving portion 264 is less likely to be released. Thus, the connector 50 is less likely to come off from the cover body 30.

Further, if a plastic deformation mark 149*a* projecting toward the receiving portion 264 is formed on the tip part of the protrusion 49, this plastic deformation mark 149*a* can be caught by the first projecting part 265. Thus, the protrusion 49 is less likely to move toward the tip side of the receiving portion 264 and the catching engagement of the protrusion 49 and the receiving portion 264 is less likely to be released. Also from this point, the connector 50 is less likely to come off from the cover body 30.

Figure 12:
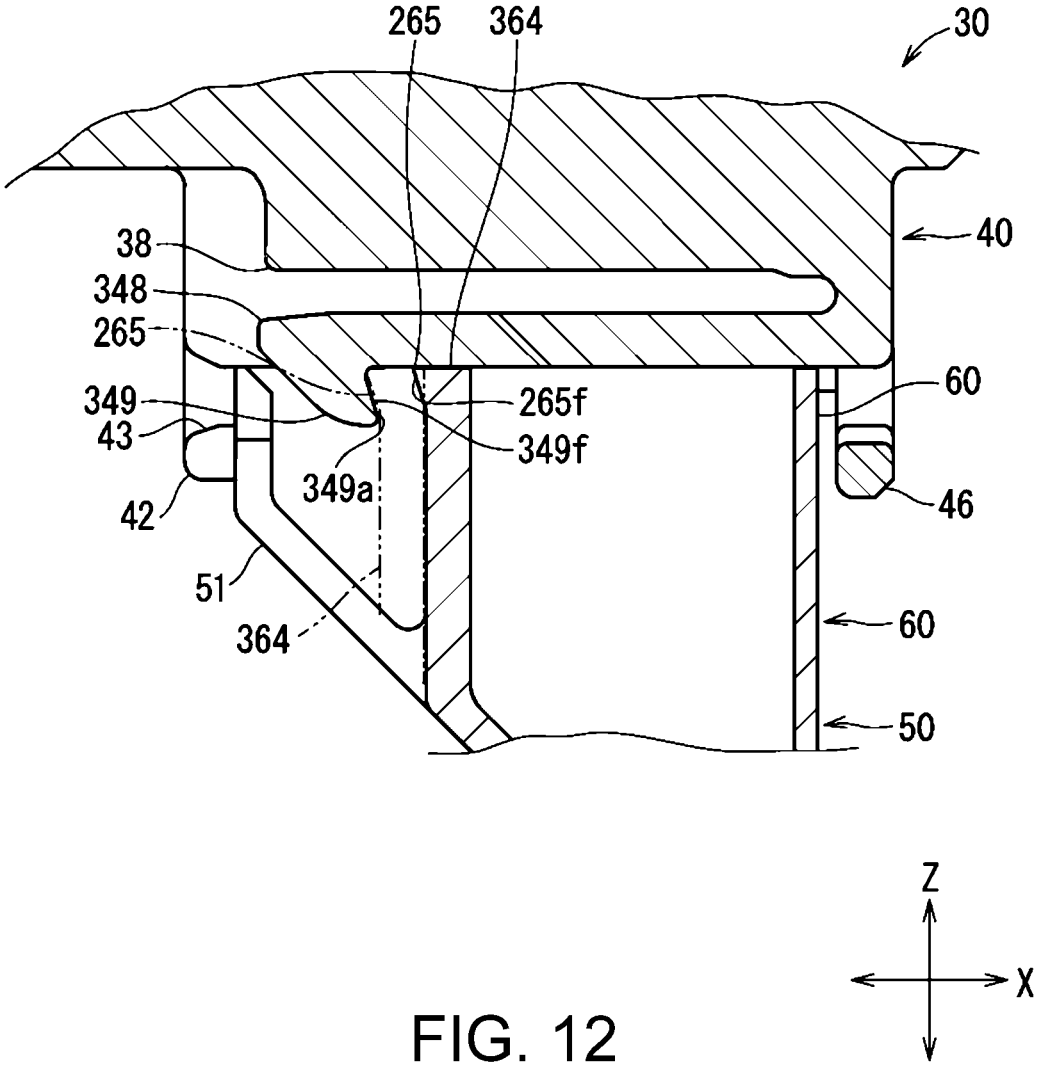
FIG. 12 is a section showing a retaining/restricting portion and a receiving portion according to a third modification.

Further, as in a third modification shown in FIG. 12, a protrusion 349 (corresponding to the protrusion 49) of a retaining/restricting portion 348 (corresponding to the retaining/restricting portion 48) may include a second projecting part 349*a* (second projection) with the supported portion 60 supported by the movable supporting portion 40. The second projecting part 349*a* is a part projecting further than a base end part of a contact surface 349*a* of the protrusion 349 (corresponding to the protrusion 49).

In this case, since a first projecting part 265 and the second projecting part 349*a* are engaged with each other with a receiving portion 364 and the retaining/restricting portion 348 caught by each other, the protrusion 349 is less likely to move toward the tip side of the receiving portion 364 and the receiving portion 364 is less likely to move toward a tip side of the protrusion 349. In this way, the catching state of the protrusion 349 and the receiving portion 364 is less likely to be released. In this way, the connector 50 is less likely to come off from the cover body 30.

Further, in the third modification, the first projecting part 265 has a first surface 265*f* gradually projecting toward the tip side of the receiving portion 364. The second projecting part 349*a* has a second surface 349*f* gradually projecting toward the tip side of the protrusion 349. It is assumed that such a force as to disengage the connector 50 from the cover body 30, e.g. such a force as to press the receiving portion 364 against the protrusion 349, acts in this case. Then, since the protrusion 349 is pressed against the first surface 265*f* via the own second surface 349*f* thereof, the protrusion 349 is pulled toward the base end side of the receiving portion 364, i.e. toward the tip side of the connector 50. Thus, the protrusion 349 and the receiving portion 364 are more reliably caught by each other. Thus, the connector 50 is less likely to come off from the cover body 30.

In this third modification, each of the first and second projecting parts may be composed of a plurality of convex parts long along the second direction Y and arranged in parallel. Even in this case, the first and second projecting parts formed in parallel can be caught by and engaged with each other.

In the above embodiment and each modification, it is not necessary that the retaining/restricting portion and the deformation restricting portion are provided on the component including the movable supporting portion, out of the first and second components, and the receiving portion is provided on the component including the supported portion, out of the first and second components. For example, in the embodiment, the connector may be formed with the retaining/restricting portion and the deformation restricting portion and the cover body may be formed with the receiving portion.

Further, the cover body may be the second component including the supported portion, and the connector may be the first component including the movable supporting portion. In this case, the supported portion may be provided instead of the movable supporting portion in the cover body 30. Further, the movable supporting portion may be provided instead of the supported portion in the connector 50.

Note that the respective configurations described in the above embodiment and respective modifications can be combined as appropriate without contradicting each other.

What is claimed is:

1. A movable support structure, comprising:

a first component including a movable supporting portion; and a second component including a supported portion, wherein:

the movable supporting portion is configured to support the supported portion when the supported portion slides toward the movable supporting portion along a first direction and a second direction orthogonal to the first direction, one of the first and second components is formed with a receiving portion, the other of the first and second components is formed with a retaining/restricting portion and a deformation restricting portion, the retaining/restricting portion is resiliently deformable in a direction to be retracted from a relative passage path for the receiving portion when the supported portion is inserted, in an insertion direction, into the movable supporting portion from a catching posture, in which the retaining/restricting portion is caught by the receiving portion, with the supported portion supported by the movable supporting portion, the retaining/restricting portion includes an arm portion, the arm portion including a protrusion disposed on a free end of the arm portion, the protrusion including a first surface that (i) is orthogonal to the insertion direction, (ii) faces in the insertion direction, and (iii) opposes a surface of the receiving portion when the retaining/restricting portion is caught by the receiving portion, and the deformation restricting portion restricts resilient deformation of the retaining/restricting portion in the direction to be retracted from the catching posture.

2. The movable support structure of claim 1, wherein:

the retaining/restricting portion has a first contact surface and a second contact surface for contacting the receiving portion to resiliently deform the retaining/restricting portion in the direction to be retracted from the catching posture when the supported portion is slid toward the movable supporting portion, the first and second contact surfaces are formed to have such a positional relationship such that the first and second contact surfaces contact the receiving portion in this order when the supported portion is slid toward the movable supporting portion, and the second contact surface is sloped more along the first direction than the first contact surface.

3. The movable support structure of claim 1, wherein:

the deformation restricting portion contacts the retaining/restricting portion with a part of the retaining/restricting portion located in the relative passage path for the receiving portion.

4. The movable support structure of claim 3, wherein:

an edge of the receiving portion on a side catching the retaining/restricting portion with the supported portion supported by the movable supporting portion is formed into a chamfered shape.

5. The movable support structure of claim 1, wherein:

a tip of a catching part of the receiving portion catches the retaining/restricting portion when the supported portion is supported by the movable supporting portion, and the catching part includes a first projection projecting further than a base end side of the catching part.

6. The movable support structure of claim 5, wherein:

the protrusion is a second projection of a caught part of the retaining/restricting portion caught by the receiving portion when the supported portion is supported by the movable supporting portion, and the second projection projects further than a base end side of the caught part.

7. The movable support structure of claim 6, wherein:

the first projection has a first surface gradually projecting toward the tip of the catching part of the receiving portion catching the retaining/restricting portion, and the second projection has a second surface gradually projecting toward the tip of the caught part of the retaining/restricting portion caught by the receiving portion.

8. The movable support structure of claim 1, wherein:

one of the first and second components is a cover body for closing an opening provided in a device housing, and the other of the first and second components is a connector to be connected to a mating connector provided in the device housing.

9. The movable support structure of claim 1, wherein:

the arm portion includes a longitudinal surface extending in the insertion direction, and a free end of the receiving portion abuts the longitudinal surface of the arm portion when the retaining/restricting portion is caught by the receiving portion.

* * * * *